US009436136B2

(12) United States Patent
Matsushita et al.

(10) Patent No.: US 9,436,136 B2
(45) Date of Patent: Sep. 6, 2016

(54) INTERMEDIATE TRANSFERER AND IMAGE FORMING APPARATUS

(71) Applicants: Makoto Matsushita, Osaka (JP); Akira Izutani, Osaka (JP); Ayano Momose, Kanagawa (JP)

(72) Inventors: Makoto Matsushita, Osaka (JP); Akira Izutani, Osaka (JP); Ayano Momose, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 187 days.

(21) Appl. No.: 14/315,488

(22) Filed: Jun. 26, 2014

(65) Prior Publication Data

US 2015/0014602 A1 Jan. 15, 2015

(30) Foreign Application Priority Data

Jul. 8, 2013 (JP) ..... 2013-142413

(51) Int. Cl.

| | |
|---|---|
| ***H01B 1/22*** | (2006.01) |
| ***G03G 15/00*** | (2006.01) |
| ***G03G 15/16*** | (2006.01) |
| *H01B 1/24* | (2006.01) |

(52) U.S. Cl.

CPC ..... *G03G 15/162* (2013.01); *H01B 1/24* (2013.01)

(58) Field of Classification Search

CPC ..... H01B 1/00; H01B 1/22; H01B 1/24; G03G 15/00; G03G 15/162; G03G 15/1685

See application file for complete search history.

(56) References Cited

U.S. PATENT DOCUMENTS

| | | | | |
|---|---|---|---|---|
| 2007/0292173 | A1* | 12/2007 | Ikeda | G03G 15/162 399/307 |
| 2008/0069594 | A1 | 3/2008 | Izutani | |
| 2008/0069599 | A1 | 3/2008 | Nakamura et al. | |
| 2008/0226997 | A1 | 9/2008 | Nakamura et al. | |
| 2008/0232849 | A1 | 9/2008 | Izutani et al. | |
| 2008/0232864 | A1 | 9/2008 | Izutani et al. | |
| 2009/0060540 | A1 | 3/2009 | Matsushita et al. | |
| 2009/0142107 | A1 | 6/2009 | Akira et al. | |
| 2009/0180791 | A1 | 7/2009 | Matsushita et al. | |
| 2009/0186289 | A1 | 7/2009 | Nakamura et al. | |
| 2009/0190949 | A1 | 7/2009 | Hamahashi et al. | |
| 2009/0238585 | A1 | 9/2009 | Hayashi et al. | |
| 2009/0257792 | A1 | 10/2009 | Nakamura et al. | |
| 2009/0279909 | A1 | 11/2009 | Matsushita et al. | |
| 2009/0324270 | A1 | 12/2009 | Yamashita et al. | |
| 2010/0055603 | A1 | 3/2010 | Nozaki et al. | |

(Continued)

FOREIGN PATENT DOCUMENTS

| | | |
|---|---|---|
| JP | 7-113029 | 5/1995 |
| JP | 9-006152 | 1/1997 |

(Continued)

*Primary Examiner* — Mark Kopec
(74) *Attorney, Agent, or Firm* — Cooper & Dunham LLP

(57) ABSTRACT

An intermediate transferer includes a polyvinylidene fluoride resin including polyvinylidene fluoride and a vinylidene fluoride-hexafluoropropylene copolymer, a conductive agent and an additive. The additive includes a polymer including a polyalkyleneoxide structure having a number-average molecular weight not less than 1,000. The polyvinylidene fluoride resin includes the vinylidene fluoride-hexafluoropropylene copolymer in an amount of from 5 to 30 parts by weight per 100 parts by weight of the polyvinylidene fluoride. The intermediate transferer includes the conductive agent in an amount of from 1.0 to 20 parts by weight and the additive in an amount of from 1.0 to 10 parts by weight per 100 parts by weight of the polyvinylidene fluoride resin.

6 Claims, 2 Drawing Sheets

(56) References Cited

U.S. PATENT DOCUMENTS

| | | | | |
|---|---|---|---|---|
| 2010/0272481 | A1 | 10/2010 | Yamamoto et al. | |
| 2010/0296848 | A1 | 11/2010 | Yamamoto et al. | |
| 2011/0008069 | A1 | 1/2011 | Matsushita et al. | |
| 2011/0217653 | A1 | 9/2011 | Izutani et al. | |
| 2011/0249994 | A1 | 10/2011 | Matsushita et al. | |
| 2012/0244464 | A1* | 9/2012 | Wu | B82Y 30/00 430/86 |
| 2012/0294657 | A1 | 11/2012 | Matsushita et al. | |

FOREIGN PATENT DOCUMENTS

| | | |
|---|---|---|
| JP | 10-034763 | 2/1998 |
| JP | 2001-018284 | 1/2001 |
| JP | 2002-365866 | 12/2002 |
| JP | 2004-331725 | 11/2004 |
| JP | 2005-099181 | 4/2005 |
| JP | 2006-313308 | 11/2006 |
| JP | 2011-186035 | 9/2011 |
| JP | 2012-047969 | 3/2012 |

* cited by examiner

INTERMEDIATE TRANSFERER AND IMAGE FORMING APPARATUS

CROSS-REFERENCE TO RELATED APPLICATIONS

This patent application is based on and claims priority pursuant to 35 U.S.C. §119 to Japanese Patent Application No. 2013-142413, filed on Jul. 8, 2013 in the Japan Patent Office, the entire disclosure of which is hereby incorporated by reference herein.

BACKGROUND

1. Technical Field

The present invention relates to an intermediate transferer and an image forming apparatus preferably used for electrophotographic image forming apparatuses such as copiers, printers and facsimiles.

2. Description of the Related Art

The intermediate transfer belt used as an intermediate transferer in the electrophotographic image forming apparatus is desired to have: uniformity of electric resistance; surface smoothness; mechanical properties such as high flexibility, high elasticity and high elongatability; high dimensional accuracy such as thickness and circumference.

The intermediate transfer belt is one of expensive components in the electrophotographic image forming apparatus, and is strongly recommended to reduce its cost. An extruded or inflated thermoplastic resin can prepare the intermediate transfer belt at low cost.

However, the intermediate transfer belt formed of the thermoplastic resin has a problem of poor detection of a toner with a toner concentration sensor when initially having high glossiness.

Japanese Patent No. JP-3295745-B1 (Japanese published unexamined application No. JP-H07-113029-A) discloses a polyvinylidene fluoride resin and/or a semiconductive resin composition formed of a fluorine rubber, carbon black and a polyalkylene ether copolymer. This specifies an amount of the carbon black, an amount of the polyalkylene ether and a range of the volume resistivity, but does not disclose anything about the glossiness, surfaceness and appearance. The polyvinylidene fluoride resin may be a homopolymer or a copolymer, but a combination ratio thereof is not disclosed at all.

The electroconductive resin composition formed of the thermoplastic resin tends to deteriorate in glossiness. This is because the resin has a small refractive index, and the carbon black as a conductive agent and an electroconductive resin as an additive enlarge the surface roughness in molding. The electroconductive resin composition tends to cause disfigurement, and when used as an intermediate transfer bell in the electrophotographic image forming apparatus, it has a small difference in refractive index with a toner and the toner is optically difficult to be detected with a toner concentration sensor.

SUMMARY

Accordingly, a need exist for an intermediate transferer having high glossiness, while allowing higher detection accuracy of toner with a toner concentration sensor.

Another object of the present invention is to provide an image forming apparatus using the intermediate transferer.

These objects and other objects of the present invention, either individually or collectively, have been satisfied by the discovery of an intermediate transferer, including a polyvinylidene fluoride resin including polyvinylidene fluoride and a vinylidene fluoride-hexafluoropropylene copolymer; a conductive agent; and an additive, wherein the additive includes a polymer including a polyalkyleneoxide structure having a number-average molecular weight not less than 1,000; the polyvinylidene fluoride resin includes the vinylidene fluoride-hexafluoropropylene copolymer in an amount of from 5 to 30 parts by weight per 100 parts by weight of the polyvinylidene fluoride; and the intermediate transferer includes the conductive agent in an amount of from 1.0 to 20 parts by weight and the additive in an amount of from 1.0 to 10 parts by weight per 100 parts by weight of the polyvinylidene fluoride resin.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
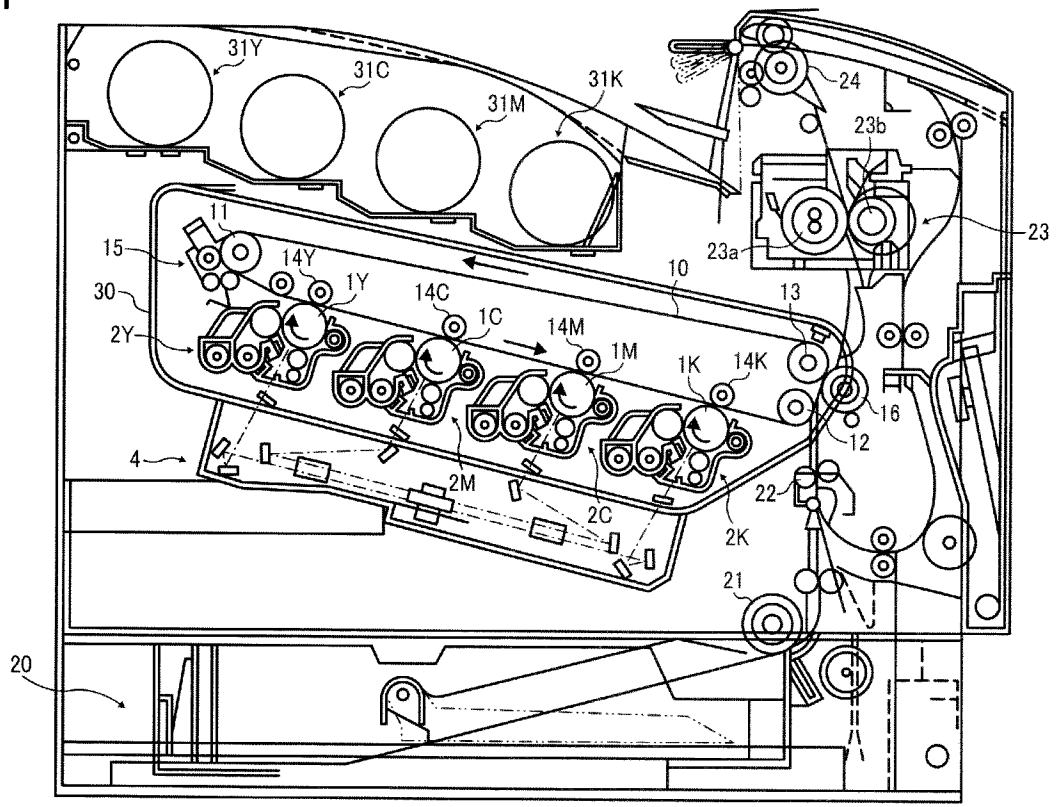
FIG. 1 is a schematic view illustrating an embodiment of the image forming apparatus of the present invention.

Example embodiments of the present invention provides an intermediate transferer having high glossiness, capable of controlling loner concentration well with a toner concentration sensor.

The other example embodiments of the present invention provides an intermediate transferer, which can be manufactured with less cost.

When an intermediate transfer belt is used in a high-voltage part, it needs a flame retardancy not less than V-1 (VTM-1 of UL94 standard when it is a film) to prevent ignition due to discharge. The resin has flame retardancy, or a retardant is added thereto. However, the retardant may cause environmental problems, influence on appearance due to bleed, and influence on other members contacting the resin.

Polyimide or polyamideimide used as the thermoplastic resin needs cast molding or centrifugal molding at high temperature and batch process, resulting in poor productivity and cost increase. In this case, coating may be formed to obtain glossiness, but which causes cracks or cost increase.

The intermediate transferer of at least one embodiment of the present invention includes a polyvinylidene fluoride resin, an additive and a conductive agent, and other components when necessary.

The intermediate transferer is preferably used as an intermediate transfer belt in an image forming apparatus using an intermediate transfer belt method, in which plural color toner images formed on each of plural image bearers such as photoreceptor drums are first transferred on the intermediate transfer belt while overlapped, and the first transferred images are secondly transferred onto a recording medium at a time.

The present inventors found a polymer including a polyalkyleneoxide structure effectively prevents a conductive route from forming because a discharge or a leak occurs when the conductive agent locally forms a conductive route.

The present inventors found PVDF (polyvinylidenefluoride) which is a thermoplastic resin having flame retardancy, capable of continuously molding at low temperature; a copolymer of PVDF and HFP (hexafluoropropylene), improving resin fluidity to increase surface glossiness; a conductive agent; and a polymer including a polyalkyleneoxide structure form an intermediate transferer capable of controlling toner concentration well with a toner concentration sensor.

<Polyvinylidene Fluoride Resin>

Specific examples of the polyvinylidene fluoride resin include, but are not limited to, homopolymers (polyvinylidene fluoride) and vinylidene fluoride-hexafluoropropylene copolymers (copolymers of VDF and HFP), and are prepared by emulsion polymerization methods or suspension polymerization methods.

Specific examples of the homopolymers include, but are not limited to, Kynar 710, 711, 720, 721, 740, 741, 760, 761, 761A, HSV900, 466, 461, 301F, 370, 9000HD, 6000HD, 1000HD from Arkema; and Solef Visc. 8, 10, 12, 15 and 20 from Solvay.

Specific examples of the copolymers include, but are not limited to, Kynar Flex 2850-00, 2851-00, 2800-00, 2801-00, 2800-20, 2821-00, 2750-01, 2751-00, 2500-20, 2501-20 and 3120-50 from Arkema; and Solef flex Visc. 8, 10, SuperFlex Visc8 from Solvay.

The polyvinylidene fluoride resin includes the vinylidene fluoride-hexafluoropropylene copolymer in an amount of from 5 to 30 parts by weight, and more preferably from 10 to 20 parts by weight per 100 parts by weight of the polyvinylidene fluoride. When less than 5 parts by weight, the tensile break elongation lowers, resulting in cracking. In addition, the surface resistivity is unstably controlled. When greater than 30 parts by weight, the tensile strength and the elasticity lower, resulting in color shifting. In addition, the distortion causes an erroneous detection of the toner concentration sensor.

<Additive>

A polymer including a polyalkyleneoxide structure having a number-average molecular weight not less than 1,000 is preferably used as the additive.

Specific examples of the polyalkyleneoxide structure include, but are not limited to, provided the number-average molecular weight is not less than 1,000, a polyethylene oxide structure, a polypropylene oxide structure, a polytetramethylene oxide structure and a polybutylene oxide structure.

Specific examples of the additive include, but are not limited to, ether compounds such as polyether ester amide, polyoxyethylene alkylether, polyoxyethylene sterol ether, a polyoxyethylene lanoline derivative, an ethyleneoxide derivative of an alkyl phenol formalin condensate, a polyoxyethylene polyoxypropylene block copolymer and polyoxyethylene polyoxypropylene alkylether; ether ester compounds such as polyoxyethylene glycerin fatty acid ester, polyoxyethylene sorbitol fatty acid ester, polyoxyethylene fatty acid alkanolamide sulfate, polyethyleneglycol fatty acid ester, ethyleneglycol fatty acid ester, fatty acid monoglyceride, polyglycerin fatty acid ester, sorbitan fatty acid ester and propylene glycol fatty acid ester.

The polyalkyleneoxide structure has a number-average molecular weight not less than 1,000, and preferably from 1,000 to 5,000. When less than 1,000, the additive increases to control the electroconductivity such that the intermediate transferer has low resistivity, resulting in lower surface glossiness thereof.

The number-average molecular weight can be measured by weight conversion with gel permeation chromatography (GPC9 and $^1$H-NMR).

The additive preferably has a refractive index not less than 1.55. The additive having high refractive index increases the glossiness. When less than 1.55, the intermediate transferer does not have enough surface glossiness to control toner concentration.

An additive having a refractive index higher than that of the polyvinylidene fluoride resin (PVDF itself has a refractive index of 1.42) increases the surface glossiness of the intermediate transferer.

The refractive index in Table 2 in POLYMER HANDBOOK (fourth Edition) Volume 2, 6/574 was used. This shows the refractive index if materials of the additive are specified. They are specified by FT-IR, NMR, LC-MS and GC-MS, and specified by FT-IR and NMR after resins are dissolved and extracted in some cases.

The additive preferably has an aromatic group. The additive including the aromatic group improves the glossiness of the intermediate transferer.

Specific examples of the additives including the aromatic group include, but are not limited to, a group represented by the following R of PMMA in PEO-OMMA.

| Polymethacrylates | |
|---|---|
| 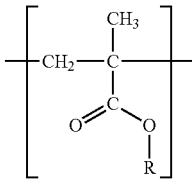 | |
| R | n |
| 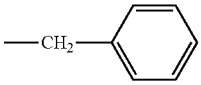 | 1.568 |
| 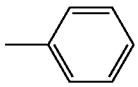 | 1.571 |
| 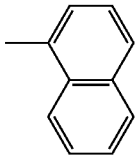 | 1.641 |

The content of the additive is not particularly limited, but preferably from 1.0 to 10 parts by weight per 100 parts by weight of the polyvinylidene fluoride resin. When less than 1.0 part by weight, the glossiness deteriorates. When greater than 10 parts by weight, the tensile break elongation lowers.

<Conductive Agent>

The conductive agents are not particularly limited, but at least one of carbon black, graphite, fulleren, carbon nanotube and graphene is preferably used.

—Carbon Black—

Specific examples of the carbon black include, but are not limited to, conductive carbon black such as ketchen black, acetylene black and oil furnace black; carbons for rubber such as SAF, ISAF, HAF, FEF, GPF, SRF, FT and MT; oxidized carbon for color ink; pyrolytic carbon; natural graphite; and artificial graphite. Among these, the conductive carbon black, particularly the ketchen black is preferably used. The ketchen black has a large number of particles per unit weight, and a small content thereof realizes desired city and minimizes deterioration of mechanical properties.

Marketed carbon blacks include, but are not limited to, Denka Black from DENKI KAGAKU KOGYO KABUSHIKI KAISHA and ketchen black EC300J from Lion Corp.

However, the carbon black deteriorates the glossiness when increased

—Graphite—

The graphite is an elemental mineral formed of carbon and has the shape of a hexagonal crystal or a hexagonal plate-like crystal. The structure is formed of layered materials in which carbons are covalently bonded, and the layers (interfaces) are bonded by van der Waals force. Therefore, the graphite is peeled in the shape of a layer. Graphene is a single layered graphite having a thickness of one atom.

The graphite has a refractive index of 2 and improves the glossiness.

Having good heat conductivity, the graphite prevents a toner from adhering to the intermediate transferer due to frictional heat from a cleaning blade when used for the intermediate transferer.

—Graphene—

The graphene is a sheet of $sp^2$-bonded carbon atom, having a thickness of one atom. The graphene has the shape of a honeycombed hexagonal lattice formed of carbon atoms and bonds thereof. The content of the graphene can be less than that of the carbon black and prevents the glossiness from lowering.

—Fullerene—

Specific examples of the fullerene include, but are not limited to, fullerene, fullerene derivatives and a mixture of the fullerene and the fullerene derivative.

The fullerene is a nucleophile-shaped carbon molecule. Specific examples thereof include, but are not limited to, C60, C70, C76, C78, C82, C84, C90, C100, and their dimers and trimers. Among these, C60, C70, and their dimers and trimers are preferably used.

The fullerene derivative is a compound including at least a carbon atom forming the fullerene bonded with an atomic group forming a part of an organic compound or an atomic group formed of an inorganic element.

Specific examples of the fullerene derivative include, but are not limited to, hydrogenated fullerene, oxidized fullerene, hydrated fullerene and halogenated (F, Cl, Br and I) fullerene.

Any of the fullerene may be used for the fullerene derivative, provided the object of the present invention is satisfied.

Base resins and additives of melted and kneaded materials deteriorate with heat when an intermediate transfer belt is formed, and the surface thereof is roughened to lower the glossiness and impair the appearance. In addition, abnormal detection of the toner concentration sensor may be caused. The fullerene having good thermostability prevents heat deterioration.

—Carbon Nanotube—

The carbon nanotube is not particularly limited in its shape, structure and size.

The carbon nanotube may be a single-layered carbon nanotube (SWNT) or a multilayered carbon nanotube (MWNT).

The single-layered carbon nanotube is not particularly limited, but preferably has a diameter of from 10 to 200 nm and a length of form 0.5 to 10 μm.

Specific examples of the single-layered carbon nanotube include an arm chair carbon nanotube, a zigzag carbon nanotube and a chiral carbon nanotube.

The multilayered carbon nanotube is not particularly limited, but preferably has a diameter of from 10 to 200 nm, a length of form 0.5 to 10 μm and 2 to 100 layers.

The carbon nanotube having a large aspect ratio has good electroconductivity even when included in a small amount and good dispersibility as well.

The intermediate transferer including the carbon nanotube having a diameter of from 10 to 200 nm and a length of form 0.5 to 10 μm in an amount of from 1 to 3% by weight has volume resistivity of from $10^8$ to $10^{11}\Omega\cdot$cm. The content thereof is less than the carbon black and the intermediate transferer has good mechanical properties.

The intermediate transferer includes the conductive agent in an amount of from 1.0 to 20 parts by weight, and preferably from 5 to 15 parts by weight per 100 parts of the polyvinylidene fluoride resin. When less than 1.0 part by weight, the intermediate transferer may have high resistivity. When greater than 20 parts by weight, the intermediate transferer may have low resistivity.

<Other Components>

Specific examples of other components include, but are not limited to, a lubricant, an electrical resistance regulator, an antioxidant, a reinforcer, a filler, a vulcanization accelerator, an extender, various pigments, a UV absorber, an antistatic agent, a dispersant and a neutralizer.

<Method of Forming Intermediate Transferer>

The polyvinylidene fluoride resin, the additive, the conductive agent and other components when necessary are melted and kneaded to prepare a kneaded mixture. Then, the kneaded mixture was subjected to a melt extrusion molding method, an injection molding method, a blow molding method or an inflation molding method to prepare the intermediate transferer of the present invention.

Specific examples of the melting and kneading machines include, but are not limited to, a monoaxial extruder, a biaxial extruder, a Banbury mixer, a roll and a kneader.

The intermediate transferer of the present invention is not particularly limited in thickness, but preferably has an average thickness of from 30 to 200 μm, and more preferably from 50 to 150 μm. When less than 30 μm, the intermediate transferer does not have enough strength and easily tears. When greater than 200 μm, the intermediate transferer loses flexibility, deteriorates in runnability, and easily cracks.

The average thickness of the intermediate transferer can be measured by a contact (pointer) type or an eddy current type thickness meter such as electron micrometer from Anritsu Corp.

The intermediate transferer of the present invention preferably has a surface glossiness not less than 40°, and more preferably from 70 to 90° at an incident angle of 60°. When less than 40°, an LED light enlisting current value of a toner adherence amount detection sensor may be over.

The surface glossiness is measured by a gloss meter such as PG-IIM from NIPPON DENSHOKU INDUSTRIES CO., LTD.

The intermediate transferer is not particularly limited in surface resistivity, but preferably has a surface resistivity of from $1\times10^{8}$ to $1\times10^{11}\Omega/\square$ (10 to 500 V).

The intermediate transferer is not particularly limited in volume resistivity, but preferably has a volume resistivity of from $1\times10^{8}$ to $1\times10^{11}\Omega\cdot$cm (10 to 500 V).

The surface resistivity is measured by Hiresta UP MCP-HT450 from Mitsubishi Chemical Analytech Co., Ltd. at 20±3° C. and 50±10% RH.

The volume resistivity after applied with 100 V for 10 sec is measured. The surface resistivity of 5 parts after applied with 100 V for 10 sec and that after applied with 500 V for 10 sec are measured and averaged.

The intermediate transferer preferably has σ/Vsg not greater than 0.10, wherein σ is a standard deviation of a reflection output voltage Vsg (V).

The reflection output voltage is a voltage converted from a reflected light quantity when the surface of the intermediate transferer is irradiated with light.

The reflection output voltage is measured by a photosensor capable of converting light quantity into a voltage. The reflection output voltages for one round of intermediate transferer are averaged.

When the σ/Vsg not greater than 0.10, i.e., the standard deviation is not greater than 1/10 of the reflection output voltage, the preciseness of the reflected light quantity measurement improves and an intermediate transferer capable of producing quality images can be provided.

Sensors have different light emitting currents to produce 3.3 V relative to a standard glass substrate due to allowances. A sensor needing 5.7 mA to produce 3.3 V relative to the standard glass substrate is used in the present invention.

The intermediate transferer of the present invention is used for various applications such as an intermediate transfer belt, a feed belt, a transfer belt, a fixing belt and developing belt. It is preferably used for an intermediate transfer belt and a transfer belt in the following image forming apparatus.

(Image Forming Apparatus)

A first embodiment of the image forming apparatus of the present invention includes an image bearer, an electrostatic latent image former forming an electrostatic latent image thereon, an image developer developing the electrostatic latent image with a toner to form a toner image, a first transferer transferring the toner image on the image bearer onto an intermediate transfer belt, a second transferer transferring the toner image on the intermediate transfer belt onto a recording medium, a fixer fixing the toner image thereon, and other means when necessary. The intermediate transfer belt is the intermediate transferer of the present invention.

A second embodiment of the image forming apparatus of the present invention includes an electrostatic latent image former forming an electrostatic latent image on an image bearer, an image developer developing the electrostatic latent image with a toner to form a toner image, a first transferer transferring the toner image on the image bearer onto an intermediate transfer belt, a second transferer transferring the toner image on the intermediate transfer belt onto a recording medium, a fixer fixing the toner image thereon, and other means when necessary. The intermediate transfer belt is the intermediate transferer of the present invention.

FIG. 1 is a schematic view illustrating an embodiment of the image forming apparatus of the present invention. The image forming apparatus in FIG. 1 forms a color image with four-color, i.e., yellow (Y), cyan (C), magenta (M) and black (K) toners.

The basic structure of an image forming apparatus, i.e., tandem image forming apparatus including plural image bearers lined in a travel direction of a surface travel member is explained.

The image forming apparatus in FIG. 1 includes four photoreceptors 1Y, 1C, 1M and 1K as image bearers. Each of the photoreceptors has the shape of a drum, and may have the shape of a belt. Each of the photoreceptors 1Y, 1C, 1M and 1K rotates in an arrow direction in FIG. 1 while contacting an intermediate transfer belt 10. Each of the photoreceptors 1Y, 1C, 1M and 1K is formed of comparatively a thin cylindrical electroconductive substrate, a photosensitive layer thereon, and a protection layer on the photosensitive layer. An intermediate layer may be formed between the photosensitive layer and the protection layer.

Figure 2:
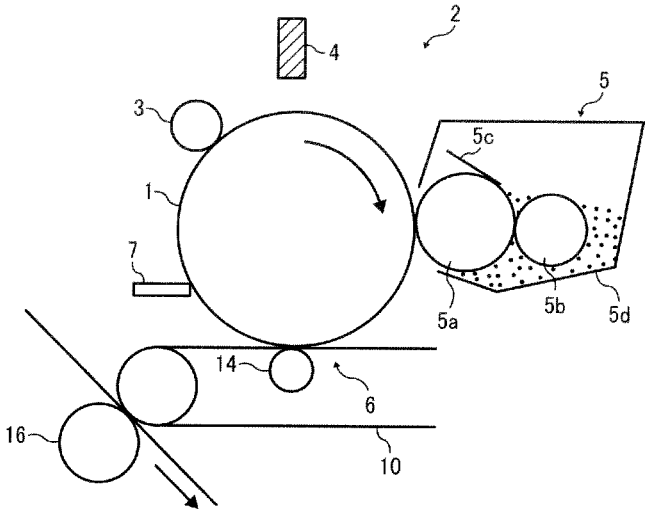
FIG. 2 is a schematic view illustrating a cross-section of an embodiment of an image forming unit in the image forming apparatus in FIG. 1.

FIG. 2 is a schematic view illustrating a cross-section of an embodiment of an image forming unit in the image forming apparatus in FIG. 1.

Since constitutions around each of the photoreceptors 1Y, 1C, 1M and 1K in each of the image forming units 2Y, 2C, 2M and 2K are the same, only one of the image forming units is illustrated and color codes Y, C, M and K are omitted. Around the photoreceptor 1, along its surface travel direction, a charger 3, an image developer 5, a transferer 6 transferring a toner image on the photoreceptor 1 onto a recording medium or an intermediate transfer belt 10, and a cleaner 7 removing an untransferred toner on the photoreceptor 1 are located in this order. A space is secured between the charger 3 and the image developer 5 so that light emitted from an irradiator 4 can reach the photoreceptor 1 to irradiate the charged surface thereof based on image data and write an electrostatic latent image thereon.

The charger 3 negatively charges the surface of the photoreceptor 1. The charger 3 includes a charging roller as a charging member charging by a contact or a proximity charging method. Namely, the charger 3 contacts or locates the charging roller close to the surface of the photoreceptor 1 and applies a negative polarity bias to the charging roller to charge the surface thereof. A DC charge bias is applied to the charging roller so that the photoreceptor 1 may have a surface potential of −500 V.

A DC bias overlapped with an AC bias can be used as the charge bias. The charger 3 may have a cleaning brush cleaning the surface of the charging roller. A thin film may be wound around each of both sides of the charging roller in the axial direction to form the charger 3 to contact the surface of the photoreceptor 1. The charging roller and the photoreceptor 1 are quite close to each other with a space of the thickness of the film therebetween. Therefore, the charge bias applied to the charging roller generates a discharge between the charging roller and the photoreceptor to charge the surface of the photoreceptor.

The charged surface of the photoreceptor 1 is irradiated by the irradiator 4 to form electrostatic latent images having each color. The irradiator 4 writes electrostatic latent images having each color on the photoreceptor 1, based on image information having each color. The irradiator 4 uses a laser, and may use other methods including an LED array and an imaging means.

Toners provided from toner bottles 31Y, 31C, 31M and 31K into the image developer 5 are fed by a developer feeding roller 5*b* and borne on a developing roller 5*a*. The developing roller 5*a* is transferred to a developing area facing the photoreceptor 1. The developing roller 5*a* travels along the surface of the photoreceptor 1 in the same direction at a linear speed faster than that of the surface of the photoreceptor 1 there. Then, the developing roller 5*a* feeds a toner onto the surface of the photoreceptor 1 while frictionizing the surface thereof. Then, the developing roller 5*a* is applied with a developing bias of −300 V from an unillustrated electric source to form a developing electric field in the developing area. An electrostatic force is applied to a toner on the developing roller 5*a* so as to move toward the electrostatic latent image. The toner on the developing roller 5*a* adheres to the electrostatic latent image on the photoreceptor 1. Thus, the electrostatic latent image on the photoreceptor 1 is developed to a toner image having each color.

The intermediate transfer belt 10 in the transferer 6 is suspended by three support rollers 11, 12 and 13 with tension, and endlessly travels in an arrow direction in FIG. 1. Toner images on the photoreceptors 1Y, 1C, 1M and 1K are overlappingly transferred onto the intermediate transfer belt 10 by an electrostatic transfer method. The electrostatic transfer method may use a transfer charger, but a transfer roller 14 having less transfer scattering is used in the present invention. Specifically, on the backside of the intermediate transfer belt 10 contacting each of the photoreceptors 1Y, 1C, 1M and 1K, each of first transfer rollers 14Y, 14C, 14M and 14K as the transferer 6 is located.

A part of the intermediate transfer belt 10 pressed by each of the first transfer rollers 14Y, 14C, 14M and 14K and each of the photoreceptors 1Y, 1C, 1M and 1K form a first transfer nip. When a toner image on each of the photoreceptors 1Y, 1C, 1M and 1K is transferred onto the intermediate transfer belt 10, a bias having a positive polarity is applied on each of the first transfer rollers 14. A transfer electric field is formed in each of the first transfer nips, and a toner image on each of the photoreceptors 1Y, 1C, 1M and 1K is electrostatically transferred onto the intermediate transfer belt 10 and adheres thereto.

When a toner image formed on the photoreceptor 1 is transferred onto the intermediate transfer belt 10, they are preferably contacted with each other with a pressure of from 10 to 60 N/m.

Around the intermediate transfer belt 10, a belt cleaner 15 removing a residual toner on the surface thereof is located. The belt cleaner 15 collects an unnecessary toner adhering to the surface of the intermediate transfer belt 10 with a fur brush and a cleaning blade. The collected unnecessary toner is fed from the belt cleaner 15 by an unillustrated feeder to an unillustrated waste toner tank. A second transfer roller 16 is located contacting a part of the intermediate transfer belt 10 suspended by the support roller 13. A second transfer nip is formed between the intermediate transfer belt 10 and the second transfer roller 16, and a transfer paper as a recording medium is fed at a predetermined timing thereto. The transfer paper is contained in a paper feed cassette 20 below the irradiator 4 in FIG. 3, and fed by a paper feed roller 21 and a pair of registration rollers 22 to the second transfer nip. The toner images overlapped on the intermediate transfer belt 10 are transferred onto a transfer paper at the second transfer nip at a time. A bias having a positive polarity is applied to the second transfer roller 16 to form a transfer electric field to transfer the toner image on the intermediate transfer belt 10 to a transfer paper.

A heating fixer 23 is located downstream of the transfer paper feed direction from the second transfer nip. The heating fixer 23 includes a heat roller 23*a* including a heater and a pressure roller 23*b* for pressure. A transfer paper having passed the second transfer nip is sandwiched between the rollers to receive heat and pressure. A toner on the transfer paper melts and a toner image is fixed thereon. A transfer paper after a toner image is fixed thereon is discharged on a paper discharge tray at the top of the apparatus.

A developing roller 5*a* as a developer bearer is partially exposed from an opening of casing of the image developer 5. A one-component developer which does not include a carrier is used. The image developer 5 includes a toner fed from toner bottles 31Y, 31C, 31M and 31K in FIG. 1. Each of the toner bottles 31Y, 31C, 31M and 31K is detachable from the image forming apparatus. Only an empty toner bottle can be exchanged to save cost. A developer (toner) in a developer container 5*d* is fed to a nip of the developing roller 5*a* as a developer bearer bearing the developer to be fed to the photoreceptor 1 while stirred by a feed roller 5*b*. The feed roller 5*b* and the developing roller 5*a* reversely (counter) rotate with each other. Further, a regulation blade 5*c* as a developer layer regulation member located so as to contact the developing roller 5*a* regulates an amount of the toner thereon to form a thin layer of the toner thereon. A toner is frictionized at a nip between the feed roller 5*b* and the developing roller 5*a*, and between the regulation blade 5*c* and the developing roller 5*a* to be controlled to have a proper charge quantity.

In the image forming apparatus, two or more of the compositions such as the latent image bearer, the charger and the image developer can be combined as a process cartridge detachable from the image forming apparatus such as copiers and printers.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Additive Preparation Example 1

<Preparation of Additive No. 2>

—Synthesis of Maleic Acid Anhydride-Modified Polypropylene—

After 800 parts by weight of polypropylene (product No. 428116 having a number-average molecular weight Mn about 5,000 from Sigma-Aldrich Co. LLC.), 320 parts by weight of maleic acid anhydride, and 80 parts of xylene were mixed at 120° C. to form a uniform solution in a glass container, 40 parts by weight of benzoyl peroxide dissolved in a small amount of xylene were dropped therein and the solution was reacted at 120° C. for 6 hrs. After the reaction was completed, a polymer was precipitated in acetone, filtrated and dried to obtain maleic acid anhydride-modified polypropylene having a number-average molecular weight Mn 2,000. A powder of the maleic acid anhydride-modified polypropylene was pelletized at 130° C. by an extruder LABO PLASTOMILL2D25S from Toyo Seiki Seisaku-sho, Ltd.

—Synthesis of Additive No. 2—

In an autoclave made of stainless steel, 60 parts of the maleic acid anhydride-modified polypropylene, 33 parts of polyoxyethylene polyoxypropylene glycol (BLAUNON P-101M having a number-average molecular weight Mn of 1,100 from Aoki Oil Industrial Co., Ltd., and 0.5 parts of zirconyl acetate were polymerized at 230° C. under reduced pressure not greater than 1 mm Hg for 4 hrs to obtain a viscous polymer.

The polymer was taken out on a belt in the shape of a strand and pelletized to obtain an additive No. 2. The additive No. 2 had a number-average molecular weight Mn of 23,000 and a refractive index of 1.49. A polyalkyleneoxide structure of the additive No. 2 had a number-average molecular weight Mn of 1,000 ($^1$H-NMR).

Additive Preparation Example 2

<Preparation of Additive No. 4>

—Preparation of Bromized Polyethylene Oxide—

(Zero point nine one five) 0.915 parts by weight of distilled 4-dimethylamino pyridine (DMAP), 20 parts by weight of dry methylene chloride, and 0.505 parts by weight of triethylamine were mixed to prepare a mixture. The mixture was placed in a three-neck flask under a nitrogen stream, and cooled to have a temperature of 0° C. while stirred by a stirrer. Then, a solution in which 2.875 parts of 2-bromoisobutylylbromide were dissolved in 20 parts by weight of methylene chloride was added to the mixture. Next, a dispersion including 25 parts of polyethylene glycol (product No. 202444 having a number-average molecular weight Mn about 3,350 from Sigma-Aldrich Co. LLC.) as polyethylene oxide (PEO) in 100 parts of dry methylene chloride was dropped in the mixture at room temperature for 1 hr, and the mixture was stirred for 18 hrs. The mixture was filtered and a half of the solvent was removed under reduced pressure to precipitate a micro initiator of bromized polyethylene oxide in cooled diethylether. The resultant precipitate was dissolved in alcohol anhydride and recrystallized for 1 day. The resultant micro initiator was filtered, washed with cooled diethylether, and suction-dried.

—Synthesis of Additive No. 4 (PEO-b-poly(isopropylmethacrylate))—

An atom transfer radical polymerization (ATRP) was performed under a chlorobenzene solution. 0.250 parts by weight of PEO-Br, 0.500 parts of isopropylmethacrylate, 0.0072 parts by weight of CuBr, 0.0234 parts of pyridine, and 1.125 parts by weight of chlorobenzene were filled in a glass tube. The glass tube was freeze-deaerated, sealed under reduced pressure, heated at 50° C., and cooled at a temperature lower than room temperature after a while. The resultant mixed solution was dissolved in tetrahydrofuran (THF), a catalyst was separated and refined through a column, and a polymer was precipitated in ether. The polymer was dried under reduced pressure at room temperature for one night, and refined to obtain an additive No. 4 formed of a block polymer of PEO and isopropylmethacrylate. The additive No. 4 had a number-average molecular weight of 19,700 and a refractive index of 1.47. A polyalkyleneoxide structure of the additive No. 4 had a number-average molecular weight Mn of 3,000 ($^1$H-NMR).

Example 1

Preparation of Intermediate Transfer Belt

One hundred (100) parts by weight of polyvinylidenefluoride (Kynar 720 from Arkema), 5 parts by weight of vinylidenefluoride-hexafluoropropylene copolymer (Kynar Flex 2850 from Arkema), 100 parts by weight of a copolymer of polyvinylidenefluoride, vinylidenefluoride and hexafluoropropylene, one part by weight of a conductive agent (DENKA BLACK from Denki Kagaku Kogyo Kabushiki Kaisha) and 10 parts of an additive No. 1 [polyether ester amide PELECTRON AS from Sanyo Chemical Industries, Ltd.] were fed to a hopper, and melted, kneaded and extruded by a biaxial kneader KZW06 from Technovel Corp. at 180 to 230° C. and 50 to 200 rpm. A resin extruded passes through cool water and pelletized by pelletizer TSM-125 from TANAKA Co., Ltd at 100 kg/hr to obtain a pellet-shaped resin composition Next, a cylindrical film was prepared by extrusion molding with a monoaxial melt kneader with a cylindrical molder GT-32 from Research Laboratory of Plastics Technology Co., Ltd., using a cylindrical molder having a diameter of 250 mm at from 180 to 250° C.

The resultant cylindrical film has a thickness of 130 μm.

Next, the resultant cylindrical film was cut to have a width of 330 mm to obtain an intermediate transfer belt having a circumferential length of 750 mm.

Next, properties of the resultant intermediate transfer belt were evaluated as follows. The results are shown in Tables 3-1 to 3-3.

<Measurement of Glossiness>

The glossiness (an average of 3 points at an incident angle of 60°) of the intermediate transfer belt was measured by a gloss meter PG-IIM from NIPPON DENSHOKU INDUSTRIES CO., LTD.

<Measurement of Unevenness of Toner Concentration Sensor (a Standard Deviation σ/a Reflection Output Voltage Vsg)>

σ is a standard deviation of a reflection output voltage Vsg (V). The reflection output voltage is measured by a photosensor capable of converting light quantity into a voltage. The reflection output voltages for one round of the intermediate transfer belt are averaged. When σ/Vsg is 0.40 or less, the intermediate transfer belt was practically usable.

[Evaluation Standard]

Excellent: σ/Vsg is 0.10 or less

Good: σ/Vsg is greater than 0.10 and 0.30 or less

Fair: σ/Vsg is greater than 0.30 and 0.40 or less

Poor: σ/Vsg is greater than 0.40

<Light Emitting Current Value>

The intermediate transfer belt was installed in a printer Ipsio C730 from Ricoh Company, Ltd., having an LED such that regular reflection light returns at 2.64 V, and the light emitting current value was measured by an oscilloscope.

<Tensile Break Elongation>

The tensile break elongation of the intermediate transfer belt was measured according to JIS K7127. When less than 20%, the intermediate transfer belt was unusable.

<Yield Stress>

The yield stress of the intermediate transfer belt was measured according to JIS K7127. When less than 35 MPa, the intermediate transfer belt was unusable.

<Appearance>

The appearance of the intermediate transfer belt was visually observed.

A projection having a height not less than 30 μm was observed: poor

No projection (including a projection having a height less than 30 μm) was observed: good <Surface Resistivity>

The surface resistivity of the intermediate transfer belt was measured on an insulative board RESITABLE of Hiresta from Mitsubishi Chemical Analytech Co., Ltd.

<Over-All Evaluation>

Even when one of the evaluation results was unusable or poor, the over-all evaluation was poor. Otherwise, good.

Examples 2 to 6 and Comparative Examples 1 to 7

The procedures for preparation and evaluation of the intermediate transfer belt in Example 1 were repeated except for changing the vinylidenefluoride-hexafluoropropylene copolymer (Kynar Flex 2850 from Arkema), the conductive agent or the additive, or an amount thereof as shown in Tables 1-1 and 1-2.

TABLE 1-1

| | Component (parts by weight) Polyvinylidenefluoride Resin | | |
|---|---|---|---|
| | PVDF Kynar720 | Copolymer of PVDF and HFP Kynar Flex2850 | Mixture of PVDF and Copolymer |
| Example 1 | 100 | 5 | 100 |
| Example 2 | 100 | 15 | 100 |
| Example 3 | 100 | 30 | 100 |
| Example 4 | 100 | 15 | 100 |
| Example 5 | 100 | 15 | 100 |
| Example 6 | 100 | 15 | 100 |
| Comparative Example 1 | 100 | 5 | 100 |
| Comparative Example 2 | 100 | 5 | 100 |
| Comparative Example 3 | 100 | 5 | 100 |
| Comparative Example 4 | 100 | 25 | 100 |
| Comparative Example 5 | 100 | 4 | 100 |
| Comparative Example 6 | 100 | 31 | 100 |
| Comparative Example 7 | 100 | 15 | 100 |

TABLE 1-2

| | Component (parts by weight) | | | | | |
|---|---|---|---|---|---|---|
| | Conductive Agent | Additive | | | | |
| | No. 1 | No. 1 | No. 2 | No. 3 | No. 4 | No. 5 |
| Example 1 | 1 | 10 | | | | |
| Example 2 | 10 | 5 | | | | |
| Example 3 | 20 | 1 | | | | |
| Example 4 | 8 | | 3 | | | |
| Example 5 | 8 | | | | 3 | |
| Example 6 | 8 | | | | | 3 |
| Comparative Example 1 | 8 | 13 | | | | |
| Comparative Example 2 | 0.5 | 5 | | | | |
| Comparative Example 3 | 10 | 0.5 | | | | |
| Comparative Example 4 | 25 | 2 | | | | |
| Comparative Example 5 | 10 | 5 | | | | |
| Comparative Example 6 | 10 | 5 | | | | |
| Comparative Example 7 | 8 | | | 3 | | |

The contents of the conductive agent and the additive are based on total weight of the mixture of PVDF and vinylidenefluoride-hexafluoropropylene copolymer.
PVDF (polyvinylidenefluoride Kynar 720 from Arkema)
Copolymer of PVDF and HFP (Kynar Flex 2850 from Arkema)
Conductive agent No. 1 (Denka Black from DENKI KAGAKU KOGYO KABUSHIKI KAISHA)
Additive No. 1 (polyether ester amide PELECTRON AS from Sanyo Chemical Industries, Ltd., having a refractive index of 1.51, and a polyalkyleneoxide structure thereof had a number-average molecular weight Mn of 4,000 ($^1$H-NMR).
Additive No. 2 (having a number-average molecular weight Mn of 23,000 and a refractive index of 1.49, and a polyalkyleneoxide structure thereof has a number-average molecular weight Mn of 1,000 ($^1$H-NMR)).
Additive No. 3 (polypropyleneglycol having a number-average molecular weight Mn of 430 and a refractive index of 1.45 from Sigma-Aldrich Co. LLC.)
Additive No. 4 (PEO-b-poly(isopropylmethacrylate) having a number-average molecular weight of 19,700 and a refractive index of 1.47, and a polyalkyleneoxide structure of thereof 4 has a number-average molecular weight Mn of 3,000 ($^1$H-NMR).

TABLE 1-2-continued

| | Component (parts by weight) | | | | | |
|---|---|---|---|---|---|---|
| | Conductive Agent | Additive | | | | |
| | No. 1 | No. 1 | No. 2 | No. 3 | No. 4 | No. 5 |

Additive No. 5 (PS-b-PEO product No. 686476 having a refractive index of 1.56 from Sigma-Aldrich Co. LLC., PS has a number-average molecular weight Mn of 21,000, and a polyalkyleneoxide structure thereof has a number-average molecular weight Mn of 1,100.

Examples 7 to 12

The procedures for preparation and evaluation of the intermediate transfer belt in Example 1 were repeated except for changing the conductive agent or an amount thereof as shown in Tables 2-1 and 2-2.

TABLE 2-1

| | Component (parts by weight) Polyvinylidenefluoride Resin | | |
|---|---|---|---|
| | PVDF Kynar720 | Copolymer of PVDF and HFP Kynar Flex2850 | Mixture of PVDF and Copolymer |
| Example 7 | 100 | 15 | 100 |
| Example 8 | 100 | 15 | 100 |
| Example 9 | 100 | 15 | 100 |
| Example 10 | 100 | 15 | 100 |
| Example 11 | 100 | 15 | 100 |
| Example 12 | 100 | 15 | 100 |

TABLE 2-2

| | Component (parts by weight) | | | | | |
|---|---|---|---|---|---|---|
| | Conductive Agent | | | | | Additive |
| | No. 1 | No. 2 | No. 3 | No. 4 | No. 5 | No. 1 |
| Example 7 | 7.5 | 0.5 | | | | 3 |
| Example 8 | 7 | 1 | | | | 3 |
| Example 9 | 4 | 3 | | | | 3 |
| Example 10 | 7 | | 1 | | | 3 |
| Example 11 | | | | 1 | | 3 |
| Example 12 | | | | | 1 | 3 |

The contents of the conductive agent and the additive are based on total weight of the mixture of PVDF and vinylidenefluoride-hexafluoropropylene copolymer.
PVDF (polyvinylidenefluoride Kynar 720 from Arkema)
Conductive agent No. 1: Denka Black from DENKI KAGAKU KOGYO KABUSHIKI KAISHA
Conductive agent No. 2: Graphite SGP from SEC CARBON, Ltd.
Conductive agent No. 3: Fullerene, nanom mix ST-F from Frontier Carbon Corp.
Conductive agent No. 4: Carbon nanotube VGCF-H from SHOWA DENKO K.K.
Conductive agent No. 5: Squamous graphene powder from XG Sciences
Additive No. 1 (polyether ester amide PELECTRON AS from Sanyo Chemical Industries, Ltd., having a refractive index of 1.51, and a polyalkyleneoxide structure thereof had a number-average molecular weight Mn of 4,000 ($^1$H-NMR).

TABLE 3-1

| | 60° Glossiness | Unevenness of Toner σ | Concentration sensor σ/Vsg |
|---|---|---|---|
| Example 1 | 40 | 0.35 | 0.106 |
| Example 2 | 45 | 0.2 | 0.061 |
| Example 3 | 40 | 0.2 | 0.061 |
| Example 4 | 50 | 0.2 | 0.061 |
| Example 5 | 53 | 0.25 | 0.076 |
| Example 6 | 57 | 0.25 | 0.076 |
| Example 7 | 57 | 0.25 | 0.076 |

TABLE 3-1-continued

| | 60° Glossiness | Unevenness of Toner σ | Concentration sensor σ/Vsg |
|---|---|---|---|
| Example 8 | 60 | 0.25 | 0.076 |
| Example 9 | 65 | 0.25 | 0.076 |
| Example 10 | 47 | 0.25 | 0.076 |
| Example 11 | 55 | 0.25 | 0.076 |
| Example 12 | 55 | 0.25 | 0.076 |
| Comparative Example 1 | 38 | 0.45 | 0.136 |
| Comparative Example 2 | 48 | 0.3 | 0.09 |
| Comparative Example 3 | 51 | 0.52 | 0.105 |
| Comparative Example 4 | 30 | 0.3 | 0.091 |
| Comparative Example 5 | 43 | 0.21 | 0.064 |
| Comparative Example 6 | 43 | 0.23 | 0.070 |
| Comparative Example 7 | 35 | 0.45 | 0.136 |

TABLE 3-2

| | Light Emitting Current (mA) | Tensile Break Elongation (%) | Yield Stress (Mpa) |
|---|---|---|---|
| Example 1 | 23 | 200 | 48 |
| Example 2 | 19 | 100 | 45 |
| Example 3 | 23 | 30 | 35 |
| Example 4 | 18 | 100 | 38 |
| Example 5 | 15 | 100 | 39 |
| Example 6 | 14 | 100 | 39 |
| Example 7 | 14 | 100 | 37 |
| Example 8 | 13 | 100 | 38 |
| Example 9 | 12 | 150 | 35 |
| Example 10 | 20 | 150 | 35 |
| Example 11 | 15 | 200 | 35 |
| Example 12 | 20 | 200 | 35 |
| Comparative Example 1 | 22 | 45 | 31 |
| Comparative Example 2 | 18 | 50 | 38 |
| Comparative Example 3 | 17 | 45 | 48 |
| Comparative Example 4 | 28 | 10 | 53 |
| Comparative Example 5 | 20 | 10 | 48 |
| Comparative Example 6 | 20 | 150 | 32 |
| Comparative Example 7 | 25 | 100 | 35 |

TABLE 3-3

| | Appearance | Surface Resistivity (Ω/□) | Overall-evaluation |
|---|---|---|---|
| Example 1 | Good | $1 \times 10^{12}$ | Good |
| Example 2 | Good | $2.5 \times 10^{8}$ | Good |
| Example 3 | Good | Under | Good |
| Example 4 | Good | $1.3 \times 10^{10}$ | Good |
| Example 5 | Good | $3.2 \times 10^{8}$ | Good |
| Example 6 | Good | $4.6 \times 10^{8}$ | Good |
| Example 7 | Good | $4.8 \times 10^{8}$ | Good |
| Example 8 | Good | $4.3 \times 10^{8}$ | Good |
| Example 9 | Good | $7.0 \times 10^{8}$ | Good |
| Example 10 | Good | $2.3 \times 10^{11}$ | Good |
| Example 11 | Good | $1.8 \times 10^{11}$ | Good |
| Example 12 | Good | $2.1 \times 10^{11}$ | Good |
| Comparative Example 1 | Poor | $3.6 \times 10^{8}$ | Poor |
| Comparative Example 2 | Good | $1.1 \times 10^{13}$ | Poor |
| Comparative Example 3 | Good | Under | Poor |
| Comparative Example 4 | Poor | Under | Poor |
| Comparative Example 5 | Good | $4.6 \times 10^{8}$ | Poor |
| Comparative Example 6 | Good | $2.6 \times 10^{8}$ | Poor |
| Comparative Example 7 | Poor | $2.9 \times 10^{11}$ | Poor |

*Under represents $10^5$ Ω/□ or less.

Example 13

Evaluation in Actual Apparatus

The intermediate transfer belt prepared in Example 1 was installed in a transfer unit of IPSIO C730 printer from Ricoh Company, Ltd. The transfer unit was installed in the printer, the printer was switched on, and a toner concentration was adjusted by a toner concentration sensor from OMRON Corp. σ/Vsg was 0.1 which was a good result. Vsg was 3.3 V. The toner concentration adjustment was properly made at a time.

Comparative Example 8

Evaluation in Actual Apparatus

The intermediate transfer belt prepared in Comparative Example 1 was installed in a transfer unit of IPSIO C730 printer from Ricoh Company, Ltd. The transfer unit was installed in the printer, the printer was switched on, and a toner concentration was adjusted by a toner concentration sensor from OMRON Corp. The toner concentration adjustment was not properly made at a time.

Having now fully described the invention, it will be apparent to one of ordinary skill in the art that many changes and modifications can be made thereto without departing from the spirit and scope of the invention as set forth therein.

What is claimed is:

1. An intermediate transferer, comprising:

a polyvinylidene fluoride resin comprising polyvinylidene fluoride and a vinylidene fluoride-hexafluoropropylene copolymer;

a conductive agent; and an additive, wherein the additive comprises a polymer comprising a polyalkyleneoxide structure having a number-average molecular weight not less than 1,000;

the polyvinylidene fluoride resin comprises the vinylidene fluoride-hexafluoropropylene copolymer in an amount of from 5 to 30 parts by weight per 100 parts by weight of the polyvinylidene fluoride; and wherein the intermediate transferer comprises the conductive agent in an amount of from 1.0 to 20 parts by weight per 100 parts by weight of the polyvinylidene fluoride resin; and the additive in an amount of from 1.0 to 10 parts by weight per 100 parts by weight of the polyvinylidene fluoride resin.

2. The intermediate transferer of claim 1, wherein the additive has a refractive index not less than 1.55.

3. The intermediate transferer of claim 1, wherein the additive has an aromatic group.

4. The intermediate transferer of claim 1, wherein the conductive agent is a member selected from the group consisting of carbon black, graphite, fullerene, carbon nanotube and graphene.

5. The intermediate transferer of claim 1, which has a surface glossiness not less than 40° at an incident angle of 60°.

6. The intermediate transferer of claim 1, which satisfies the following relationship:

$$\sigma/Vsg \leq 0.10$$

wherein σ is a standard deviation of Vsg (V) which is an average of reflection output voltages measured for one round of the intermediate transferer.

* * * * *